US006820996B1

(12) United States Patent
Fan

(10) Patent No.: US 6,820,996 B1
(45) Date of Patent: Nov. 23, 2004

(54) ORNAMENTAL LIGHT WITH TASSEL ATTACHED TO THE LIGHT

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 22 days.

(21) Appl. No.: 10/430,221

(22) Filed: May 7, 2003

(51) Int. Cl.[7] ..... F21S 6/00; F21V 7/04

(52) U.S. Cl. ..... 362/121; 362/252; 362/566; 362/800; 362/806; 362/807

(58) Field of Search ..... 362/555, 565, 362/566, 567, 121, 122, 123, 124, 152, 252, 396, 434, 240, 241, 800, 806, 807, 808; 40/550, 551, 552

(56) References Cited

U.S. PATENT DOCUMENTS 4,833,580 A * 5/1989 Allen ..... 362/451
5,315,492 A * 5/1994 Davenport ..... 362/122
6,039,458 A * 3/2000 Coates et al. ..... 362/249

* cited by examiner

*Primary Examiner*—John Anthony Ward
*Assistant Examiner*—Bao Q. Truong
(74) *Attorney, Agent, or Firm*—Bacon & Thomas PLLC

(57) ABSTRACT

An ornamental light has a frame, a translucent body securely connected to the frame and a tassel assembly securely attached to a combination of the frame and the translucent body so that when LEDs in the translucent body are lit, reflection of the light via tassels of the tassel assembly is able to present a rich colorful decorative effect.

2 Claims, 3 Drawing Sheets

ORNAMENTAL LIGHT WITH TASSEL ATTACHED TO THE LIGHT

BACKGROUND OF THE INVENTION

1. Field of the Invention

The present invention relates to an ornamental light, and more particularly to an ornamental light with tassels attached to an outer surface of the ornamental light to reflect the light from the ornamental light and to increase decorative effect from the color of the tassel.

2. Description of Related Art

A conventional ornamental light normally has a tube-like body and light bulbs received in the body. The operator is then able to use the body to form any shape as required. To strengthen the rigidity of the ornamental light, a frame having a shape the same as that of the ornamental light is used and is securely engaged with the ornamental light. Therefore, when the light bulbs in the body are lit, the ornamental light is able to present a figure with the contour illuminated accordingly.

Having a figure hanging in the air, on the door etc. is very dull and conventional but due to the lack of a novel alternative, people have used this kind of ornamental light to increase the festival atmosphere for years. Therefore, how to really increase the joyful touch to the surroundings by novel illumination has been a long unfulfilled problem.

To overcome the shortcomings, the present invention tends to provide an improved ornamental light to mitigate and obviate the aforementioned problems.

SUMMARY OF THE INVENTION

The primary objective of the present invention is to provide an improved ornamental light which is able to reflect light from the ornamental light, but also to increase a colorful effect.

In order to accomplish the foregoing objective, the ornamental light of the present invention has a translucent body with light bulbs (or light emitting diodes, LEDs) received in the translucent body, a frame with a shape the same as that of the translucent body and tassels wrapped around the translucent body and the frame so that when the ornamental light is lit, the light is able to penetrate through the translucent body and be reflected outwards by the tassels. Because of the color of the tassels, when the light is reflected, the reflected light beam is colorful.

Other objects, advantages and novel features of the invention will become more apparent from the following detailed description when taken in conjunction with the accompanying drawings.

DETAILED DESCRIPTION OF THE PREFERRED EMBODIMENT

Figure 1:
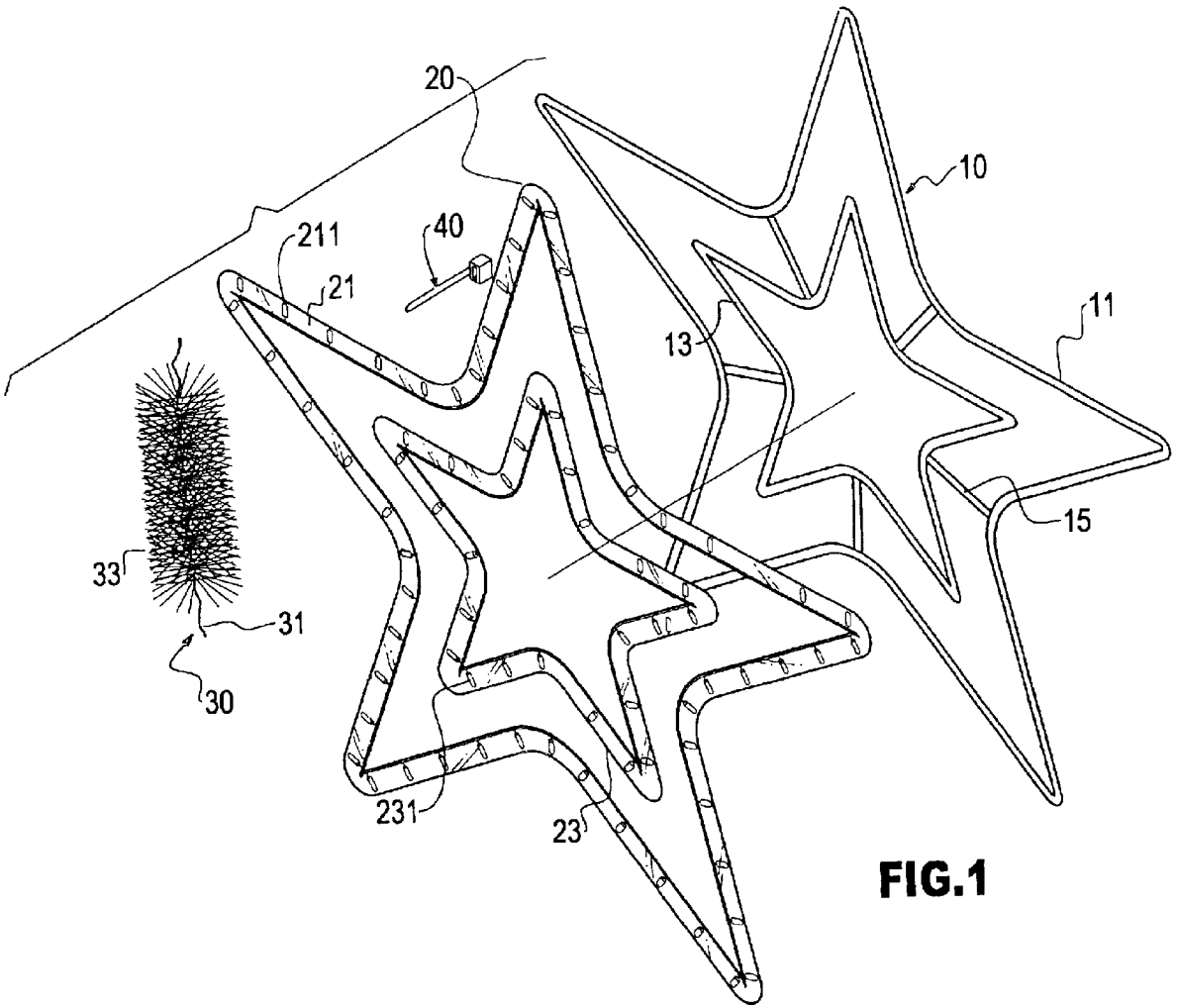
FIG. 1 is an exploded perspective view of the ornamental light of the present invention.

With reference to FIG. 1, the ornamental light in accordance with the present invention has a frame (10), a translucent body (20) and tassel assembly (30).

The frame (10) is made of iron or steel and has a primary star-shaped frame (11) and a secondary star-shaped frame (13) securely connected to the primary star-shaped frame (11) via connecting bars (15) that engage an outer contour of the secondary star-shaped frame (13) to an inner contour of the primary star-shaped frame (11).

The translucent body (20) includes a primary body (21) and a secondary body (23). The primary body (21) has multiple LEDs (211) securely received in the primary body (21). The secondary body (23) has multiple LEDs (231) securely received in the secondary body (23). Multiple retainers (40) are provided for engagement between the primary body (21), the secondary body (23), the primary star-shaped frame (11) and the secondary star-shaped frame (13).

The tassel assembly (30) has two wires (31) and multiple tassels (33) securely connected to the two wires (31).

Figure 2:
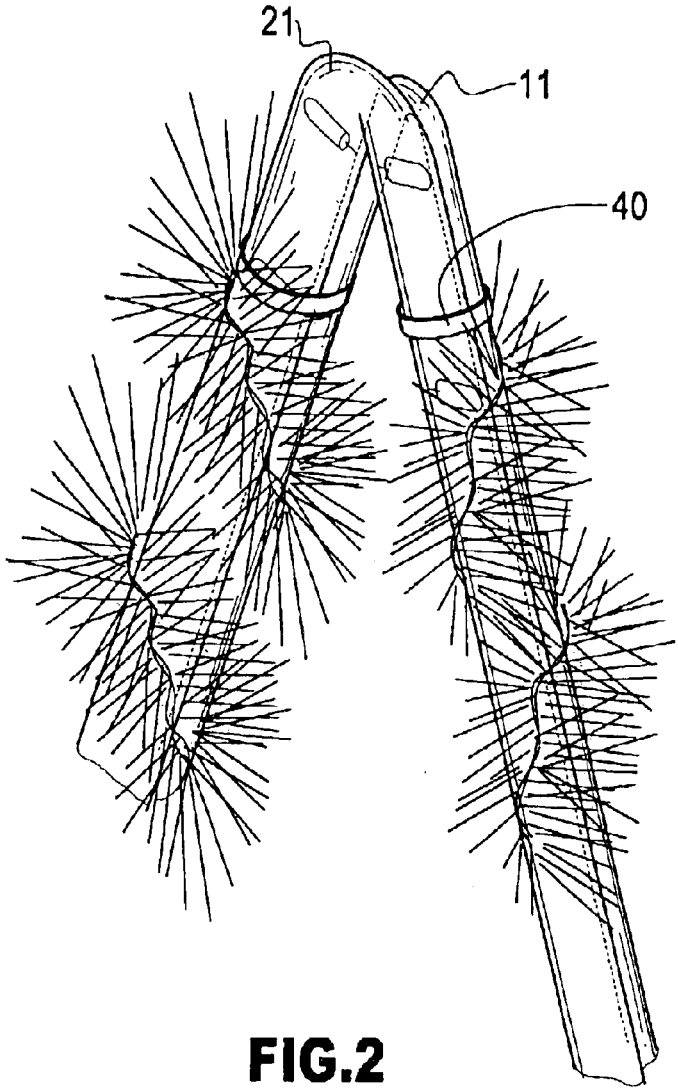
FIG. 2 is a perspective view of a portion of the assembled ornamental light of the present invention.

With reference to FIG. 2, when the ornamental light of the present invention is in assembly, the retainers (40) are applied to securely combine the primary star-shaped frame (11) a nd the primary body (21). The retainers (40) are also applied to secure the engagement between the secondary star-shaped frame (13) and the secondary frame (23). After the translucent body (20) is securely connected to the frame (10), the tassel assembly (30) is then wrapped around the combination of the translucent body (20) and the frame (10) via the two wires (31).

Figure 3:
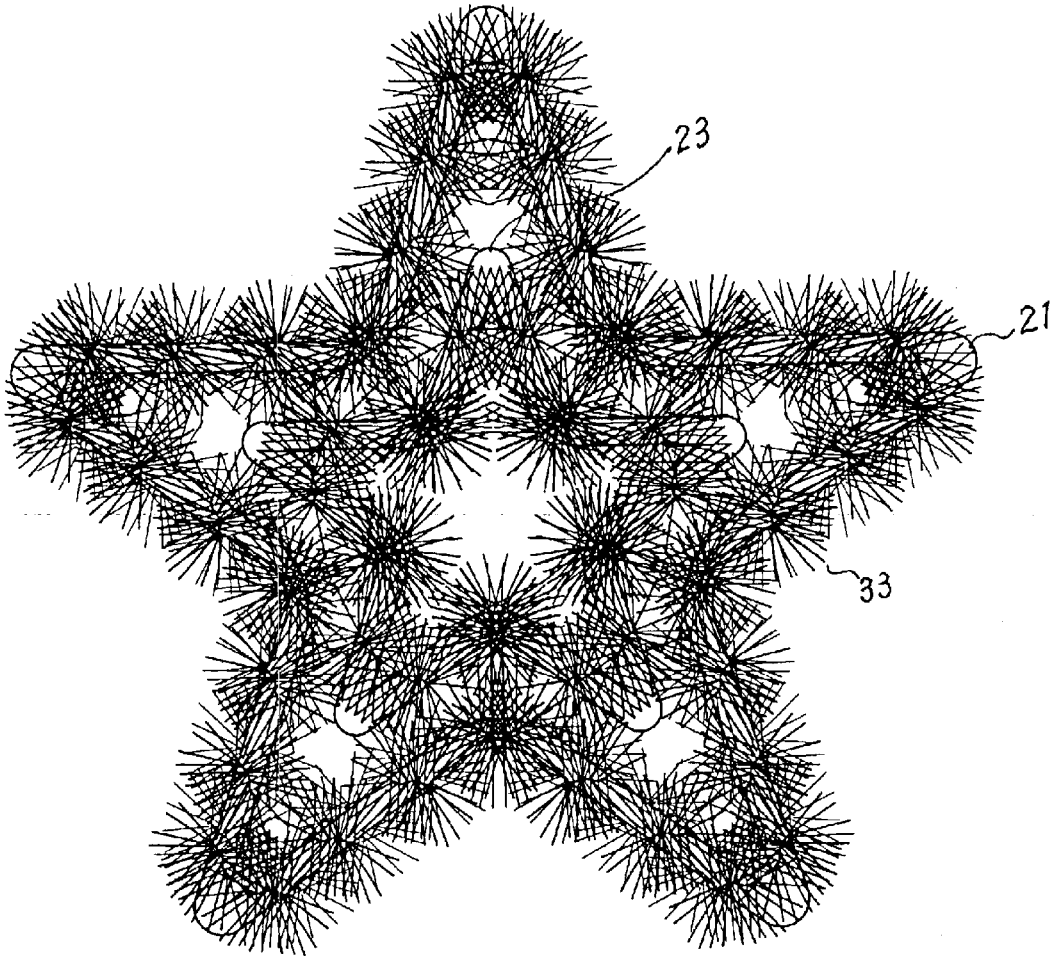
FIG. 3 is a front view of the ornamental light in assembly.

With reference to FIG. 3, after assembly of the ornamental light of the present invention, it is noted that the tassels (33) are all over the primary body (21) and the secondary body (23). Thus, when the ornamental light is lit, the light from both the primary body (21) and the secondary body (23) is reflected to present a spectacular display. Also, due to the color of the tassels (33), the reflected light is colorful. Thus, the festival atmosphere is enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ornamental light comprising:

a frame having a primary frame and a secondary frame securely connected to the primary frame via connecting bars engaging an outer contour of the secondary frame to an inner contour of the primary frame;

a translucent body having a primary body and a secondary body, wherein the primary body has multiple LEDs securely received in the primary body, the secondary body has multiple LEDs securely received in the secondary body;

multiple retainers provided to engage the primary body, the secondary body, the primary frame and the secondary frame; and a tassel assembly having two wires mounted around an outer periphery of the primary frame, the secondary frame, the primary body and the secondary frame and multiple tassels securely connected to the two wires, whereby the tassels are able to reflect light from the LEDs in the primary body and the secondary body respectively so as to increase a decorative effect.

2. An ornamental light comprising:

a frame;

a translucent body having multiple LEDs securely received in the translucent body;

multiple retainers provided to securely engage the frame with the translucent body; and a tassel assembly having a wire mounted around an outer periphery of the translucent body and the frame and multiple tassels securely connected to the wire, whereby the tassels are able to reflect light from the LEDs in the translucent body so as to increase a decorative effect.

* * * * *